US006551227B1

(12) United States Patent
Whitten

(10) Patent No.: US 6,551,227 B1
(45) Date of Patent: Apr. 22, 2003

(54) DEVICE FOR SEIZING OF FLAT MATERIAL ON A TRANSPORTING SURFACE

(75) Inventor: David Elliot Whitten, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/456,869

(22) Filed: Dec. 8, 1999

(51) Int. Cl.[7] ..... B31B 1/14

(52) U.S. Cl. ..... 493/356; 493/359; 493/360; 493/365; 83/343; 83/345

(58) Field of Search ..... 493/365, 370, 493/371, 340, 356, 359, 360; 83/343, 345

(56) References Cited

U.S. PATENT DOCUMENTS

| | | | | |
|---|---|---|---|---|
| 880,465 A | | 2/1908 | Price | |
| 1,782,674 A | | 11/1930 | Baumgartner | |
| 1,900,288 A | | 3/1933 | Jordhoy | |
| 2,031,780 A | | 2/1936 | Lamatsch | 270/77 |
| 2,499,570 A | | 3/1950 | Crafts | 164/68 |
| 3,188,084 A | * | 6/1965 | Raybuck | |
| 3,521,512 A | * | 7/1970 | Woessner | |
| 3,999,454 A | * | 12/1976 | Tiso et al. | |
| 4,368,879 A | | 1/1983 | Hoshi | 270/6 |
| 4,445,881 A | | 5/1984 | Bullen et al. | 493/424 |
| 4,465,269 A | | 8/1984 | Petersen | 270/47 |
| 4,601,693 A | * | 7/1986 | Richey | |
| 4,765,604 A | * | 8/1988 | Trogan | |
| 4,917,665 A | * | 4/1990 | Couturier | |
| 4,957,280 A | | 9/1990 | Motooka | 270/47 |
| 5,000,729 A | * | 3/1991 | Yamauchi | |
| 5,004,451 A | * | 4/1991 | Prum | |
| 5,024,128 A | | 6/1991 | Campbell, Jr. | 83/26 |
| 5,122,109 A | | 6/1992 | Kubota et al. | 493/427 |
| 5,312,032 A | | 5/1994 | Rautenberg | 225/100 |
| 5,405,126 A | | 4/1995 | Mack | 270/6 |
| 5,520,378 A | | 5/1996 | Kepert et al. | 270/8 |
| 5,622,113 A | * | 4/1997 | Hansen | |
| 5,755,654 A | * | 5/1998 | Schulz et al. | |
| 5,806,392 A | | 9/1998 | Cleall et al. | 83/155 |
| 5,921,906 A | * | 7/1999 | Nagano | |
| 6,179,764 B1 | | 1/2001 | Eckert | 493/356 |

FOREIGN PATENT DOCUMENTS

| | | | |
|---|---|---|---|
| EP | 0220644 | 5/1987 | B65H/45/16 |
| EP | 0931748 | 7/1999 | B65H/45/16 |

* cited by examiner

*Primary Examiner*—Eugene Kim
(74) *Attorney, Agent, or Firm*—Davidson, Davidson & Kappel, LLC

(57) ABSTRACT

The present invention is related to a device for seizing a flat material (25) such as a web of material (1) on a transporting surface (15). A first cylinder (7) has at least one knife assembly (12) assigned to its respective surface (9). A paper conducting cylinder (14) such as a transfer cylinder or a folding cylinder supports a flat material (25) on its respective outer circumference (15). Biased product seizing element (27) assigned to said circumference (9) of said first cylinder (7) are provided, adopting on cooperation with said leading edge (25) supported on said outer surface (15) of the paper conducting cylinder (14) an engaging position (32).

20 Claims, 2 Drawing Sheets

DEVICE FOR SEIZING OF FLAT MATERIAL ON A TRANSPORTING SURFACE

FIELD OF THE INVENTION

The present invention is related to a device for seizing of flat material on a transporting surface such as signatures on a outer surface of a paper conducting cylinder such as a folding cylinder of a folding apparatus.

BACKGROUND OF THE INVENTION

EP 0 220 644 A2 discloses a vacuum system for combination fold off control. A signature folder is disclosed in which a vacuum system is provided to prevent tail whipping of the signature when the direction of movement thereof is reversed. The folder provides two counter-rotating cylinders. A portion of the signature moves along the periphery of one cylinder and than reverses direction to move on to the periphery to the other cylinder. A vacuum system is provided adjacent to the signature when it reverses direction. The vacuum system includes a pair of guides and a central, freely rotatable vacuum roll. The vacuum causes the reversing portion of the signature to move into engagement with the guide and rolls and eliminates tail whipping. Further, it guides the signature so that it smoothly moves on to the periphery of the subsequent roll. The major drawback of said vacuum solution according to EP 0 220 644 A2 resides in the fact that by a vacuum source only the outermost layer of a respective leading edge of a web of material can be securely seized on a respective cylinder surface. A web of material including a plurality of different ribbons or different layers is not secured against opening-up during the transitory period after a respective signature has been severed from a web of material and a new leading edge has been created.

A recently published application which is not necessarily prior art to the present application, EP 0 931 748 A1 discloses a pinless folder apparatus assigned to a rotary printing press. This solution comprises a first paper-conducting cylinder the surface of which supports a web of material to be processed in the pinless folder apparatus. Said first paper-conducting cylinder cooperates with a cutting cylinder assigned thereto having a number of knife assemblies assigned to its respective outer circumference. According to this solution of the state of the art cyclically actuatable product holding means are provided either on the circumference of that first paper-conducting cylinder or on the respective circumference of the said cutting cylinder. Said product holding means are actuated so as to engage a respective leading edge supported on said first cylinder surface in counterclockwise direction, to seize a newly created leading edge after a signature has been severed from the respective lead edge of the web of material.

With this solution said respective holding elements have to be activated by a respective cam element which has to be arranged on a respective cylinder's end surface. A cam/cam follower assembly is quite space consuming and subject to maintenance and premature wear. The respective surface of the cam has to be hardened to be wear-resistant which renders the actuating component of the respective holding element more difficult to manufacture.

SUMMARY OF THE INVENTION

In view of the solution according to the state of the art it is accordingly an object of the present invention to provide for a product-seizing element actuatable by cooperation with a paper transporting surface supporting the respective flat material to be seized.

A further object of the present invention is to eliminate cam activation of product-seizing elements.

Still further, an object of the present invention is to provide for reliable positioning of a respective leading edge of a web of material upon a cutting operation when severing a signature from a multi-layered web of material.

According to the present invention a device for seizing a flat material on a supporting surface includes:

- a first cylinder having knife assemblies assigned to its circumference,
- a paper conducting cylinder supporting a flat material on its outer circumference and
- biased product seizing elements assigned to said circumference of said first cylinder adopting upon cooperation with said flat material received on said outer circumference an engaging position.

Advantages of the present invention are the automatic actuation of pretensioned product seizing elements by contact of said product seizing elements with a respective opposite arranged transporting surface without activation of particular elements such as a cam or a cam follower. Said product seizing elements are advantageously mounted integrated within a respective surface of a cylinder either adopting a disengaged extending position due to the biasing force or a position in which they engage in a respective leading edge automatically exerting a force upon said leading edge due to the respective subjecting with a pretensioning element.

In further advantageous embodiments according to the present invention said product seizing elements by punctual contact only exert a seizing force upon said respecting flat material which results in a non-marking of the respecting leading edge by said product seizing elements and consequently in an non opening-up of said multi-layered web of material when including a plurality of ribbons. Said product seizing elements either may extend spaced apart from one another over the entire width of said web of material or the respective paper-conducting cylinder or maybe arranged in the middle or the respective lateral edge portion of said cylinder.

Said product seizing elements either can be biased by having a pretensioning element assigned to corresponding housings of said product seizing elements or having said product seizing elements subjected to a pressure source such as the pneumatic or hydraulic system.

In a very advantageous embodiment according to the present invention said product seizing elements are received movably within a knife box which easily is exchangeably arranged on a respective circumference of a first cylinder, such as respective cutting cylinder. To allow for an engagement of the very first part of the newly created leading edge of a multi-layered web of material said product seizing elements are arranged within a knife box in an inclined orientation. During the respective engaging movement of leading edge said heads of said product seizing elements contact said leading edge close to the cross-cut, severing a respective signature from a web of material thus creating a new product leading edge. By the close orientation of the respective product seizing element to the cross-cut a reliable registration of the respective new created product seizing element is guaranteed maintaining register of said leading edge upon the supporting surface allowing for a clear sharp cross-cutting operation between said two cylinders. Said accurate registration of the newly created product seizing element on the respective transporting surface of the transfer cylinder results in a high accuracy of the following cross-folding operations to be executed within a folder apparatus such as a pinless folding apparatus.

Said product seizing elements may include a rounded head portion and a pad or a layer to provide for a smooth contact surface for said leading edge to prevent marking on the respective product leading edge received and supported on said paper conducting cylinder.

A respective product seizing device advantageously can be used on cooperating cylinders such as folding-/ or paper-conducting cylinders of a folder apparatus, assigned to a web fed rotary printing press for commercial and newspaper applications.

According to a method of operation of a product seizing element on a surface of a cylinder in a folding apparatus said leading edge of a flat material is supported on a transporting surface, whereas said product seizing elements adopt a first disengaged position, prior to the engagement of the leading edge. In a first stage of cooperation said cylinder surfaces do not cooperate with each other but rather move according to the rotational speed gradually towards each other in circumferential direction. Upon contacting of the product seizing elements with respective lead edge portions of the web of material received on the transporting surface of said transfer cylinder a seizing force is exerted upon the outer surface of the leading edge to prevent the leading edge of the web of material received from opening-up. The respective leading edge is not released until it has been captured by a gripper extending out of the respective surface of said paper conducting cylinder such as a transfer cylinder. Upon further rotation of said cylinder having said product seizing elements assigned thereto said seizing elements adopt a second disengaged position. Said product seizing element move out of the cylinder surface again since they are subject to a biasing force, whereas that newly created leading edge of the web of material is securely gripped by said gripper element.

BRIEF DESCRIPTION OF THE DRAWINGS

The novel features which are considered as characteristic for the invention are set forth in particular in the attended claims. The invention itself however both as to its construction and its method of operation together with additional objects and advantages thereof will be best understood from the following description of a specific embodiment when read in connection with the accompanying drawings in which:

DESCRIPTION OF PREFERRED EMBODIMENTS

Figure 1:
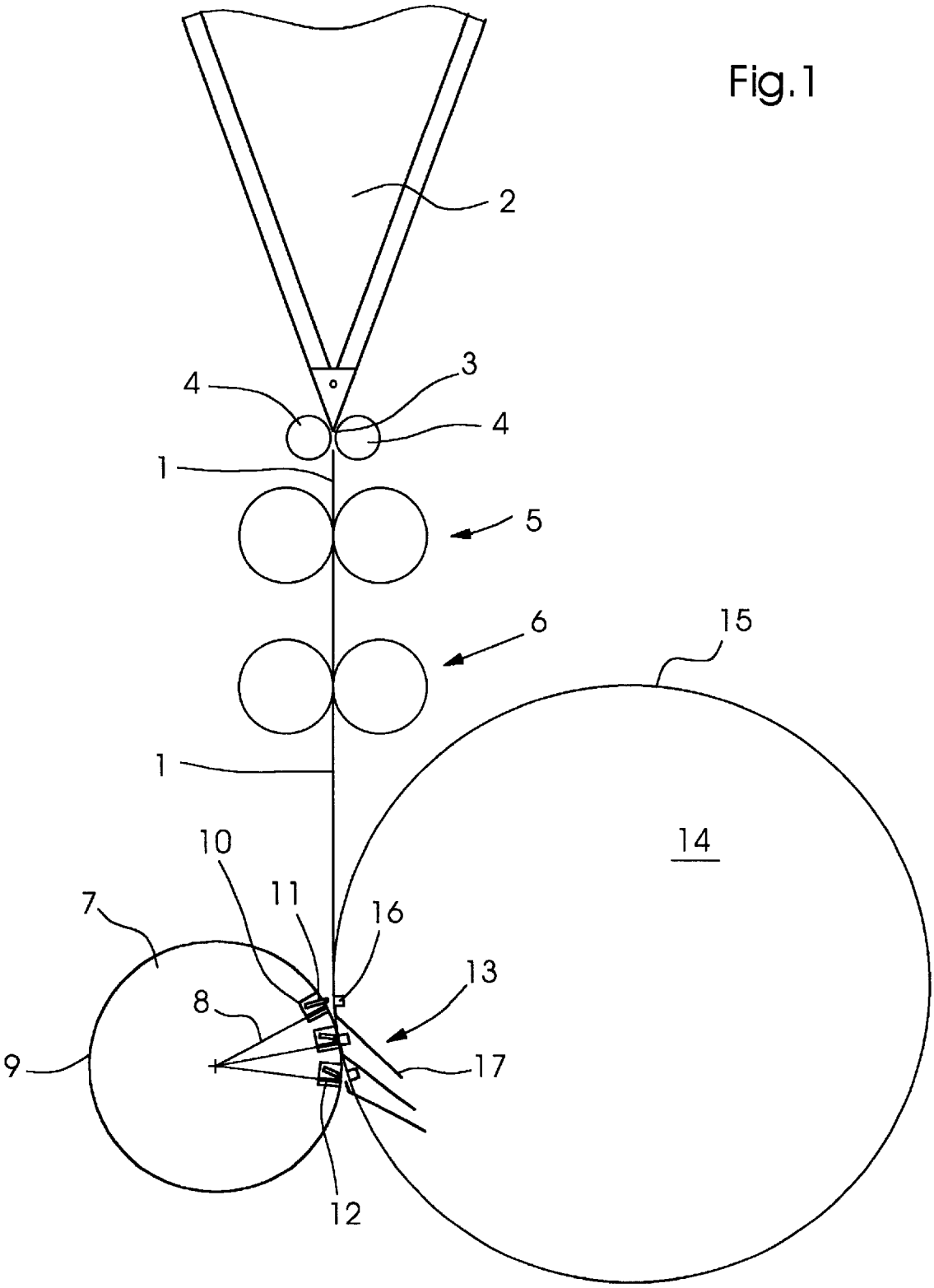
FIG. 1 is a schematically given side elevation of a respective folder assembly having two cooperating cylinders and FIG. 2 is a detailed view of the cutting area of the cross-cutting area given in three different stages of the cylinders' rotation.

FIG. 1 shows a schematically given side elevation of a respective folder assembly having two cooperating cylinder surfaces.

According to the embodiment of the folder assembly given in FIG. 1, a web of material 1 may pass a former board 2 arranged prior to a first and second pair of nip rollers 5, 6, respectively. Upon passage of said former board 2 a single web of material 1 or a multi-layered web of material 1 including a plurality of ribbons may receives a first longitudinal fold. Said former board 2 is not necessarily provided; the web of material 1 may pass said nip 5, 6 respectively on the subsequent web travel pass without being longitudinally folded.

As forwarded past said first pair of nip rollers 5 and said second pair of nip rollers 6 said web of material 1 enters a cutting area 13 between two cooperating cylinders 7, 14 respectively. Said first cylinder 7 may be a cutting cylinder 7, the outer surface of which provided with a curvature according to the respective radius 8. On the respective outer surface 9 of said cutting cylinder 7 at least one knife assembly 12 may be arranged which may be received in a respective knife box 10. The different radii 8 shown in the embodiment according to FIG. 1 show different stages of rotation of said first cylinder 7, a cutting cylinder. Corresponding to the different stages of rotation of said first cylinder 7 the different stages of rotation of a adjacently arranged transfer cylinder 14 are shown. To the respective cylinder's outer cylinder surface 15 of the transfer or a paper-conducting cylinder 14 such as a transfer cylinder, anvil bars.16 are assigned which are received in grooves. Still further to the outer surface 15 of the respective product paper-conducting cylinder 14 a gripper means 17 is assigned. Both said anvil bars 16 and said gripper means 17 are given in three different rotational stages which will be described in further details according to FIG. 2. By cooperation of the respective knife assemblies 12 with said cutting counterpart 16 arranged on the opposite surface 15 of said paper-conducting cylinder signatures are severed from the respective incoming material. The accuracy of further folding operations to be processed upon further passage of signatures through the folder assembly significantly depends upon the accuracy with which said cross-cutting operation is performed and with which accuracy the respective leading edge is supported on the respective surface 15 of the paper-conducting cylinder 14. Any misregistration occuring here will jeopardize the folding quality in subsequently following folding operations.

Figure 2:
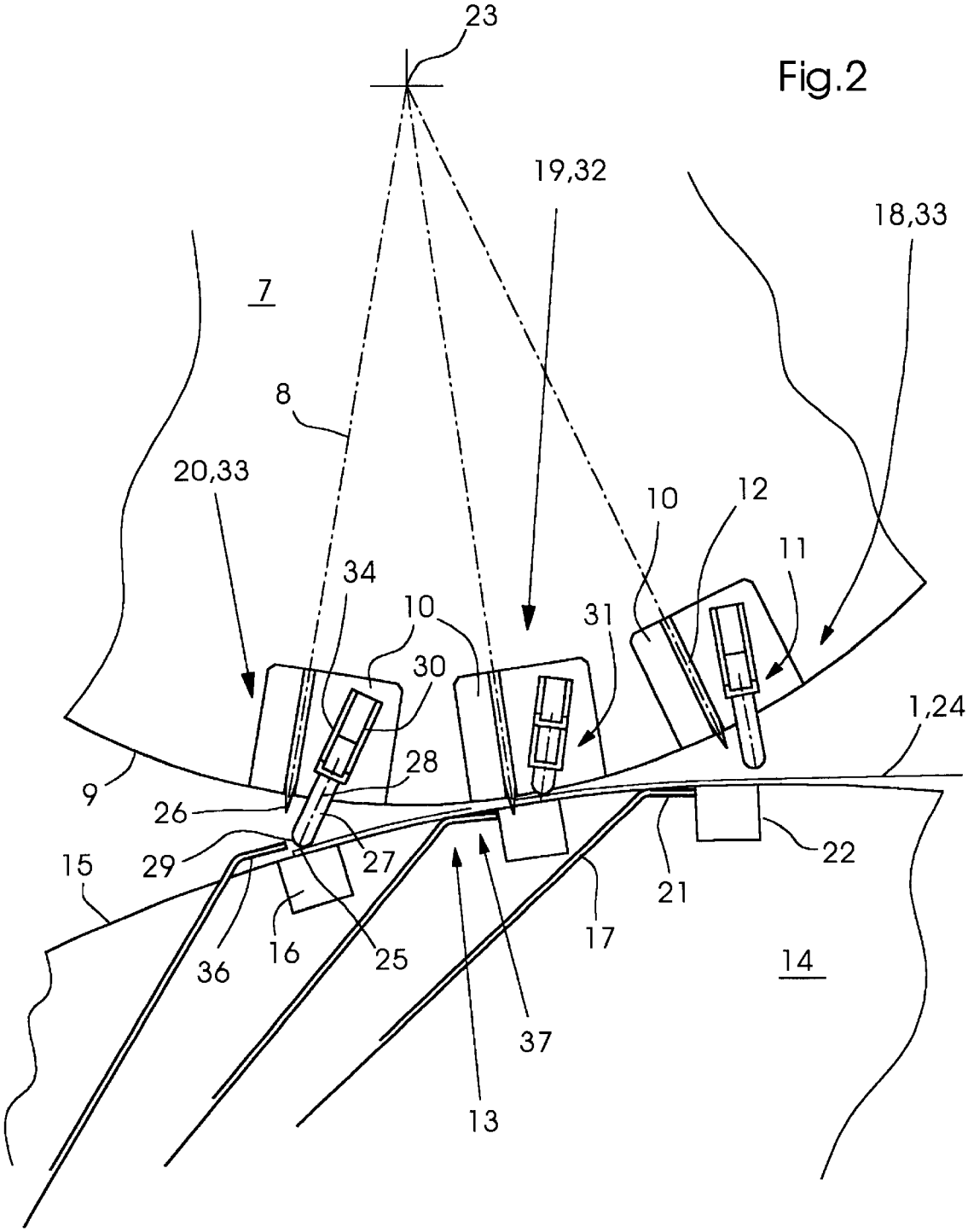

FIG. 2 is a detailed view of the cutting area given in three different stages of rotation identified by reference numerals 18, 19 and 20 respectively.

Said first cylinder 7 such as a cutting cylinder rotates about its respective axis 23 from which the respective outer surface 9 extends by a radius 8. In the respective outer surface 9 of said cutting cylinder 7 knife assemblies 12 are received. Said knife assemblies 12 are received in grooves with respective knife boxes 10. Said knife boxes are arranged within said cutting cylinder by fastening means not shown in greater detail here to allow for a quick exchange for the respective knife boxes upon wear of the respective cutting tips 26 of said knives 12. In an inclined position 31 within said knife boxes 10 respective product seizing elements 27 are arranged. Said product seizing elements 27 include an engaging bolt element 27 having a rounded portion 29. Said rounded portion 29 may include a coating to prevent marking of the respective leading edge when contacted by said head 29 of said engaging bolt 27. Within the respecting housing of said engaging bolt a biasing element such as a pretensioning spring is provided to keep the engaging bolt 27 in its extended position which will be described below.

It is conceivable as well as to to have said housing of said engaging bolt connected to a pressure source such as a pneumatic or hydraulic system.

The respective cooperating cylinder such as a paper-conducting cylinder or a transfer cylinder 14 receives assigned to its respective outer circumference a plurality of counterparts 16 to perform the cross-cut operation. Said anvil bars are received in grooves 22 extending over the width of the respective paper-conducting cylinder 14. Furthermore, said paper-conducting cylinder 14 is equipped with product grippers 17 given only schematically here. Said product gripper 17 comprise a hook-shaped seizing area and are given here in an extended gripper position 36 and a respective retracted group of position 37. The cooperation of said cutting cylinder 7 and said product-conducting cylinder 14 is as follows:

A web of material 1, 24 including a single ribbon or a plurality of ribbons either longituidally folded or not enters said cutting area 13 between the cooperating surfaces 9 and 15 of said cylinders. In a first stage of rotation identified by reference numerals 18, 33, respectively, said engaging bolt 27 is given in its extended position. In the extended position said engaging board is moved out of surface 9 of the respective cutting cylinder 7 due to its pretentioning force exerted by a spring element to give an example. In this stage of rotation the web of material 1, 24 is supported by the outer circumference 15 of the respective paper-conducting cylinder. In this stage of rotation the corresponding knife 12 has not contacted the respective leading edge 25 of the web of material 1, 24 and said gripper 17 arranged in the periphery of the surface 15 of the respective paper-conducting cylinder is shown in its retracted position identified by reference numeral 37.

Upon further rotation of the respective outer surface 9, 15, respectively in the respective senses of rotation, the head 29 of the respective engaging bolt 27 surrounded by its guide 34, gradually seizes the respective leading edge 25 of the web of material 1, 14 from which then by cooperation of said knife 12 with said anvil bar 16 a signature is severed. During the engagement of said engaging bolt 27 with the respective web of material 1, 24 in the front area thereof a reliable cutting operation is guaranteed and an accurate positioning of said newly created leading edge 25 of the respective multi-layered web of material is maintained. Due to the force exerted upon the engaging board by the respective biasing or pretentioning element the outer surface of the leading edge of the web of material is prevented from opening-up during passage of the cutting zone 13. In this stage of rotation of the respective cylinders identified by reference numerals 19 and 32 the respective gripper element 17 is still shown in its retracted position identified by reference numeral 37. The force exerted by the pretentioning or biasing element upon said engaging bolt 27 is dependent on the thickness of the respective leading edge, on the respective thickness of the paper stock and of the number of ribbons of the web of material 1, 24 to be processed.

Upon further rotation of cutting cylinder 7 and the paper conducting cylinder 14 said engaging bolt 27 gradually extends out of the respective guide 34 due to the biasing or pretentioning force exerted thereon by a biasing element such as a spring, the previously mentioned pressure source such as a pneumatic or hydraulic system. Consequently, by further extension of said engaging bolt 27 out of its guide 34 the force with which said leading edge is urged against the outer surface 15 of the respective paper-conducting cylinder 14 gradually decreases. However, by the force still exerted upon the leading edge 25, the leading edge 25 is kept in its position above said anvil bar 16. As can be derived from the third stage of rotation 20 given in FIG. 2, the gripper now gradually moves into an extended gripper position 36 to seize the respective leading edge 25 which will be released by said engaging bolt's 27 head portion 29 by further rotation of said cutting cylinder 7 about its axis of rotation 23. In the respective third stage of rotation 20 said engaging bolt 27 adopts a disengaged position identified by reference numeral 33. Upon further rotation of said paper conducting cylinder 14 in its respective sense of rotation and the cutting cylinder 7 according to its sense of rotation said product seizing element 27-shaped as an engaging bolt for example will keep its disengaged position 33, respectively, and upon a completion of a revolution will seize a respective new web of material when supported on the respective outer surface 15 of the paper-conducting cylinder.

The automatic actuatable product seizing elements according to the present invention can advantageously be used on pinless folder assemblies for use on web-fed rotary printing presses for commercial and newspaper purposes. The advantage according to the present invention is given by a smooth but reliable product handling so that no penetration holes, slots or whatever are formed on the respective signatures so that a further trimming or a further loss of paper during trimming operations can be avoided.

Reference Numeral List

1 web of material
2 former board
3 former nose
4 former rollers
5 first pair of nips
6 second pair of nips
7 cutting cylinder
8 radius
9 outer surface
10 knife box
11 product seizing element
12 knife
13 cutting area
14 paper conducting cylinder
15 cylinder surface
16 anvil bar
17 gripper
18 first stage of rotation
19 second stage of rotation
20 third stage of rotation
21 gripper head
22 groove
23 axis of rotation
24 web of material
25 leading edge
26 knife tip
27 engaging bolt
28 center line
29 rounded head
30 biasing element
31 inclined position
32 engaging position
33 disengaging position
34 guide
35 support
36 extended group of position
37 retracted group of position

What is claimed is:

1. A folder for printed products comprising:

a first cylinder having a surface and having knife assemblies assigned to the surface;

a paper-conducting cylinder having an outer circumference and supporting a flat material on the outer circumference;

the first cylinder having a biased product seizing element assigned to the surface of the first cylinder, the biased product seizing element engaging said flat material received on the outer circumference of the paper-conducting cylinder so as to hold the flat material on the paper-conducting cylinder; and at least one product gripper attached to the paper conducting cylinder for rotation therewith, the product gripper selectively extending beyond the outer circumference of the paper conducting cylinder to hold the flat material against the outer circumference.

2. The device as recited in claim 1 wherein said product seizing element in the engaging position punctually engages on a leading edge of a web of material.

3. The device as recited in claim 1 wherein said product seizing element is located extending over the width of the surface of the first cylinder.

4. The device as recited in claim 1 wherein said product seizing element is biased by a pretensioning element.

5. The device as recited in claim 1 wherein said product-seizing element is mounted in an inclined orientation with respect to one of the knife assemblies.

6. The device as recited in claim 1 wherein said product seizing element is received in a respective knife box mounted in a periphery of said first cylinder.

7. The device as recited in claim 1 wherein said product seizing element comprises rounded head portions.

8. The device as recited in claim 1 wherein said product seizing element is equipped with a friction reducing coating.

9. The device as recited in claim 1 wherein said product seizing element in the engaged position seizes a respective leading edge adjacent to the impact zone of said knife assemblies.

10. The device as recited in claim 1 wherein the product seizing element is biased through a pressure source.

11. A paper conducting assembly in a folder apparatus, comprising:

a first cylinder having a circumference and knife assemblies assigned to the circumference;

a paper conducting cylinder having an outer circumference and supporting a flat material on the outer circumference;

a biased product seizing element assigned to the circumference of said first cylinder engaging said flat material on said outer circumference so as to hold the flat material on the paper conducting cylinder; and at least one product gripper attached to the paper conducting cylinder for rotation therewith, the product gripper selectively extending beyond the outer circumference of the paper conducting cylinder to hold the flat material against the outer circumference.

12. A pinless folder apparatus for processing a flat material comprising:

a first cylinder having a circumference and having knife assemblies assigned to the circumference;

a paper conducting cylinder having an outer circumference and supporting a flat material on the outer circumference;

a biased product seizing element assigned to the outer circumference; and a biased seizing element assigned to the circumference of the first cylinder adopting an engaging position upon cooperation with said flat material received on said outer circumference.

13. A method for holding a flat material in a folder of a printing press on different supporting surfaces comprising the steps of:

supporting a leading edge of a web of material on a first supporting surface of a paper conducting cylinder with a biased product seizing element in a first engaged position, the biased product seizing element being on another cylinder cooperating with the paper conducting cylinder;

having a product seizing element adopt a first disengaged position upon entry of the web of material in a cutting area; and gripping the leading edge with a gripper while the biased product seizing element is in the first engaged position, the product gripper extending beyond an outer circumference of the other cylinder to hold the leading edge against the outer circumference.

14. The method as recited in claim 13 wherein said product seizing element adopts a second disengaged position after the gripping step.

15. A device for seizing a flat material on a transporting surface comprising:

a first cylinder having a surface and having knife assemblies assigned to the surface;

a paper-conducting cylinder having an outer circumference and supporting a flat material on the outer circumference; and a biased engaging bolt assigned to the surface, the biased engaging bolt adopting an engaging position upon cooperation with said flat material received on the outer circumference; and at least one product gripper attached to the paper conducting cylinder for rotation therewith, the product gripper selectively extending beyond the outer circumference of the paper conducting cylinder to hold the flat material against the outer circumference.

16. The device as recited in claim 15 wherein said engaging bolt is received in a respective knife box mounted in a periphery of said first cylinder.

17. The device as recited in claim 15 wherein said engaging bolt comprises rounded head portions.

18. The device as recited in claim 15 wherein said engaging bolt is equipped with a friction reducing coating.

19. The device as recited in claim 15 wherein said engaging bolt is biased by a pretensioning element.

20. The device as recited in claim 15 wherein said engaging bolt in the engaged position seizes a respective leading edge adjacent to the impact zone of said knife assemblies.

* * * * *

UNITED STATES PATENT AND TRADEMARK OFFICE

CERTIFICATE OF CORRECTION

PATENT NO. : 6,551,227 C1
APPLICATION NO. : 90/007261
DATED : September 4, 2007
INVENTOR(S) : David Elliot Whitten It is certified that error appears in the above-identified patent and that said Letters Patent is hereby corrected as shown below:

Title Page, Item

(73) Assignee:

Correct name from "Heidelberger Druckmaschinen AG, Heidelberg (DE)" to "Goss International Americas, Inc., Dover, NH (US)."

Signed and Sealed this
Twenty-eighth Day of December, 2010

David J. Kappos

David J. Kappos
*Director of the United States Patent and Trademark Office*

US006551227C1

(12) EX PARTE REEXAMINATION CERTIFICATE (5884th)

United States Patent

Whitten

(10) Number: US 6,551,227 C1

(45) Certificate Issued: Sep. 4, 2007

(54) DEVICE FOR SEIZING OF FLAT MATERIAL ON A TRANSPORTING SURFACE

(75) Inventor: David Elliot Whitten, Barrington, NH (US)

(73) Assignee: Heidelberger Druckmaschinen AG, Heidelberg (DE)

Reexamination Request:
No. 90/007,261, Oct. 21, 2004

Reexamination Certificate for:

| | |
|---|---|
| Patent No.: | **6,551,227** |
| Issued: | **Apr. 22, 2003** |
| Appl. No.: | **09/456,869** |
| Filed: | **Dec. 8, 1999** |

(51) Int. Cl.
*B31B 1/14* (2006.01)

(52) U.S. Cl. ..... 493/356; 493/359; 493/360; 493/365; 83/343; 83/345

(58) Field of Classification Search ..... None
See application file for complete search history.

(56) References Cited

U.S. PATENT DOCUMENTS

| | | | | |
|---|---|---|---|---|
| 880,465 | A | | 2/1908 | Price |
| 953,063 | A | | 3/1910 | Sheldon |
| 1,782,674 | A | | 11/1930 | Baumgartner |
| 1,900,288 | A | | 3/1933 | Jordhoy |
| 2,031,780 | A | | 2/1936 | Lamatsch |
| 2,499,570 | A | | 3/1950 | Crafts |
| 3,188,084 | A | | 6/1965 | Raybuck |
| 3,521,512 | A | | 7/1970 | Woesnner |
| 3,999,454 | A | | 12/1976 | Tiso et al. |
| 4,368,879 | A | | 1/1983 | Hoshi |
| 4,445,881 | A | | 5/1984 | Bullen et al. |
| 4,465,269 | A | | 8/1984 | Petersen |
| 4,601,693 | A | | 7/1986 | Richey |
| 4,765,604 | A | | 8/1988 | Trogan |
| 4,917,665 | A | | 4/1990 | Couturier |
| 4,957,280 | A | | 9/1990 | Motooka |
| 5,000,729 | A | | 3/1991 | Yamauchi |
| 5,004,451 | A | | 4/1991 | Prum |
| 5,024,128 | A | | 6/1991 | Campbell, Jr. |
| 5,122,109 | A | | 6/1992 | Kubota et al. |
| 5,312,032 | A | | 5/1994 | Rautenberg et al. |
| 5,405,126 | A | | 4/1995 | Mack |
| 5,520,378 | A | | 5/1996 | Kepert et al. |
| 5,622,113 | A | | 4/1997 | Hansen |
| 5,653,429 | A | | 8/1997 | Michalik et al. |
| 5,707,330 | A | * | 1/1998 | Kiamco et al. ..... 493/357 |
| 5,711,220 | A | | 1/1998 | Calbrix et al. |
| 5,755,654 | A | | 5/1998 | Schulz et al. |
| 5,806,392 | A | | 9/1998 | Cleall et al. |
| 5,921,906 | A | | 7/1999 | Nagano |
| 6,093,139 | A | | 7/2000 | Belanger |
| 6,179,764 | B1 | | 1/2001 | Eckert |
| 6,283,906 | B1 | | 9/2001 | Kostiza |

FOREIGN PATENT DOCUMENTS

| | | |
|---|---|---|
| EP | 0 220 644 B1 | 6/1991 |
| EP | 0 931 748 B1 | 7/1999 |
| EP | 0931748 A1 | 7/1999 |

* cited by examiner

*Primary Examiner*—Bibhu Mohanty

(57) ABSTRACT

The present invention is related to a device for seizing a flat material (25) such as a web of material (1) on a transporting surface (15). A first cylinder (7) has at least one knife assembly (12) assigned to its respective surface (9). A paper conducting cylinder (14) such as a transfer cylinder or a folding cylinder supports a flat material (25) on its respective outer circumference (15). Biased product seizing element (27) assigned to said circumference (9) of said first cylinder (7) are provided, adopting on cooperation with said leading edge (25) supported on said outer surface (15) of the paper conducting cylinder (14) an engaging position (32).

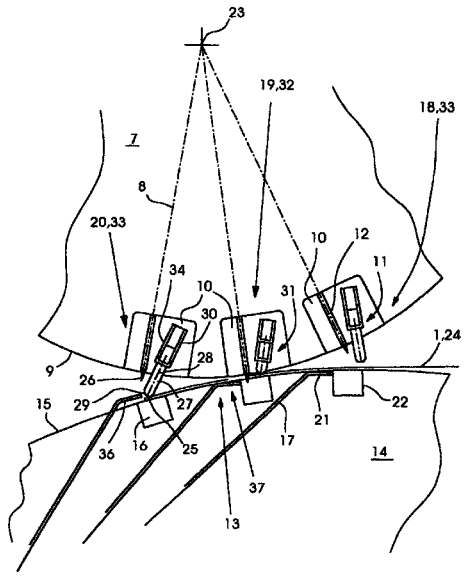

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 13–14 are cancelled.

Claims 1, 2, 11, 12 and 15 are determined to be patentable as amended.

Claims 3–10, 16–20, dependent on an amended claim, are determined to be patentable.

New claims 21–26 are added and determined to be patentable.

1. A folder for printed products comprising:

*a former board for imparting a longitudinal fold to an incoming web of flat material:* a first cylinder having a surface and having knife assemblies assigned to the surface;

a paper-conducting cylinder having an outer circumference and supporting [a flat] *the folded web* material on the outer circumference;

the first cylinder having a biased product seizing element assigned to the surface of the first cylinder, the biased product seizing element engaging said [flat] *folded web* material received on the outer circumference of the paper-conducting cylinder so as to hold the [flat] *folded web* material on the paper-conducting cylinder *while the folded web is being cut by one of the knife assemblies*; and at least one product gripper attached to the paper conducting cylinder for rotation therewith, the product gripper selectively extending beyond the outer circumference of the paper conducting cylinder to hold the [flat] *folded web* material against the outer circumference.

2. The device as recited in claim 1 wherein said product seizing element in the engaging position punctually engages on a leading edge of [a web of] *the folded web* material.

11. A paper conducting assembly in a folder apparatus, comprising:

*a former board for imparting a longitudinal fold to an incoming web of flat material;* a first cylinder having a circumference and knife assemblies assigned to the circumference;

a paper conducting cylinder having an outer circumference and supporting [a flat] *the folded web* material on the outer circumference;

a biased product seizing element assigned to the circumference of said first cylinder engaging said [flat] *folded web* material on said outer circumference so as to hold the [flat] *folded web* material on the paper conducting cylinder *while the folded web is being cut by one of the knife assemblies*; and at least one product gripper attached to the paper conducting cylinder for rotation therewith, the product gripper selectively extending beyond the outer circumference of the paper conducting cylinder to hold the [flat] *folded web* material against the outer circumference.

12. A pinless folder apparatus for processing a flat material comprising:

*a former board for imparting a longitudinal fold to an incoming web of flat material;* a first cylinder having a circumference and having knife assemblies assigned to the circumference;

a paper conducting cylinder having an outer circumference and supporting [a flat] *the folded web* material on the outer circumference;

a biased product seizing element assigned to the outer circumference; and

[a] *the* biased *product* seizing element assigned to the circumference of the first cylinder adopting an engaging position upon cooperation with said [flat] *folded web* material received on said outer circumference *while the folded web is being cut by one of the knife assemblies*.

15. A device for seizing a flat material on a transporting surface comprising:

*a former board for imparting a longitudinal fold to an incoming web of flat material;* a first cylinder having a surface and having knife assemblies assigned to the surface;

a paper-conducting cylinder having an outer circumference and supporting a [flat] *the folded web* material on the outer circumference; and a biased engaging bolt assigned to the surface, the biased engaging bolt adopting an engaging position upon cooperation with said [flat] *folded web* material received on the outer circumference *while the folded web is being cut by one on the knife assemblies*; and at least one product gripper attached to the paper conducting cylinder for rotation therewith, the product gripper selectively extending beyond the outer circumference of the paper conducting cylinder to hold the [flat] *folded web* material against the outer circumference.

*21. The folder according to claim 1, wherein said product seizing element is received in a respective knife box mounted in a periphery of said first cylinder and is mounted in an inclined orientation with respect to a knife assembly in said respective knife box.*

*22. The device of claim 15, wherein said biased engaging bolt is received in a respective knife box mounted in a periphery of said first cylinder and is mounted in an inclined orientation with respect to a knife assembly in said respective knife box.*

*23. The folder according to claim 1, wherein the paper conducting cylinder includes an anvil bar, the anvil bar receiving said one of the knife assemblies to cut the folded web.*

*24. The paper conducting assembly according to claim 11, wherein the paper conducting cylinder includes an anvil bar, the anvil bar receiving said one of the knife assemblies to cut the folded web.*

*25. The pinless folder according to claim 12, wherein the paper conducting cylinder includes an anvil bar, the anvil bar receiving said one of the knife assemblies to cut the folded web.*

*26. The device according to claim 15, wherein the paper conducting cylinder includes an anvil bar, the anvil bar receiving said one of the knife assemblies to cut the folded web.*

* * * * *